US008474956B2

(12) United States Patent
Takahashi et al.

(10) Patent No.: US 8,474,956 B2
(45) Date of Patent: Jul. 2, 2013

(54) PRINTING APPARATUS AND INK SUPPLY METHOD THEREOF

(75) Inventors: Atsushi Takahashi, Kawasaki (JP); Yuji Hamasaki, Kawasaki (JP); Naomi Yamamoto, Abiko (JP); Kei Yoshizawa, Tokyo (JP); Yoshinori Nakagawa, Kawasaki (JP); Nobuhiro Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 13/161,202

(22) Filed: Jun. 15, 2011

(65) Prior Publication Data

US 2011/0310141 A1 Dec. 22, 2011

(30) Foreign Application Priority Data

Jun. 18, 2010 (JP) ..... 2010-139962

(51) Int. Cl.
*B41J 2/175* (2006.01)

(52) U.S. Cl.
USPC ..... 347/85

(58) Field of Classification Search
CPC ..... B41J 2/175; B41J 2/17509; B41J 2/17513
USPC ..... 347/5–7, 84, 85
See application file for complete search history.

(56) References Cited

U.S. PATENT DOCUMENTS 7,121,652 B2 10/2006 Harada
2011/0128329 A1* 6/2011 Yoshino et al. ..... 347/85

FOREIGN PATENT DOCUMENTS

JP 2002-1992 A 1/2002

* cited by examiner

*Primary Examiner* — An Do
(74) *Attorney, Agent, or Firm* — Canon USA Inc IP Division

(57) ABSTRACT

A printing apparatus, including a print head having a discharge port, a stirring portion configured to stir ink in an ink tank, a valve disposed on a supply path, a cap for capping the discharge port, and a pressure reducing unit configured to reduce pressure in the cap, executes, in parallel, a stirring operation for stirring ink in the ink tank by the stirring portion and a pressure reducing operation for reducing pressure on the print head side from the valve in the supply path by the pressure reducing unit with the valve closed.

6 Claims, 8 Drawing Sheets

PRINTING APPARATUS AND INK SUPPLY METHOD THEREOF

BACKGROUND OF THE INVENTION

1. Field of the Invention

The present invention relates to a printing apparatus (recording apparatus) that discharges ink from a print head (recording head) to a sheet to print an image, and to an ink supply method thereof. In particular, the present invention relates to a printing apparatus that prints an image on a sheet using an ink, a component of which easily precipitates, and to an ink supply method thereof.

2. Description of the Related Art

In U.S. Pat. No. 7,121,652, disposing a valve unit configured to open and close an ink supply path between an ink cartridge and a recording head to drive a suction pump with the valve unit opened is discussed. Further, opening the valve unit with a negative pressure accumulated in an internal space of a capping unit to generate quick flow of ink on an ink flow path from the ink cartridge to a nozzle opening of the recording head is discussed. Thus, enabling air bubbles remaining in the ink flow path in a state of being stuck to be released from the ink flow path is discussed. A method which reduces pressure on the recording head side from a valve on the ink supply path with the valve, provided on the way of the ink supply path, closed to open the valve with a negative pressure accumulated, thereby allowing ink to be supplied to the recording head is hereinafter referred to as "choke suction". In U.S. Pat. No. 7,121,652, as ink, black, cyan, magenta, and yellow inks are discussed. However, any component of ink is not discussed therein.

In a printer which uses ink a component of which easily precipitates, it is required to stir the ink to make the density of ink uniform. As a configuration to stir ink, there is a configuration in which a user operates an operation knob to stir ink in an ink pack and then attaches the ink pack to the printer. When the above-described choke suction is intended to be performed on the printer using ink a component of which easily precipitates, the user needs to operate the operation knob to stir ink and then perform the choke suction to supply ink to the recording head. Accordingly, the choke suction is performed after ink is stirred. Thus, there is an issue to require a long period of time until the printer is brought into a usable state.

SUMMARY OF THE INVENTION

The present invention is directed to a printing apparatus capable of shortening a period of time to be required for a stirring operation of ink and an ink supply operation to a print head, and to an ink supply method thereof.

According to an aspect of the present invention, a printing apparatus includes a print head having a discharge port for discharging ink, an ink tank for storing ink to be supplied to the print head, a supply path for supplying ink from the ink tank to the print head, a stirring portion configured to stir ink in the ink tank, a valve disposed on the supply path, a cap for capping the discharge port, a pressure reducing unit configure to reduce pressure in the cap, and a control unit configured to control the stirring portion and the pressure reducing unit, wherein the control unit executes, in parallel, an operation that stirs ink in the ink tank by the stirring portion and an operation that reduces pressure on the print head side from the valve in the supply path by the pressure reducing unit with the valve closed, such that the valve is opened during the stirring operation to allow ink to be supplied from the ink tank to the print head.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
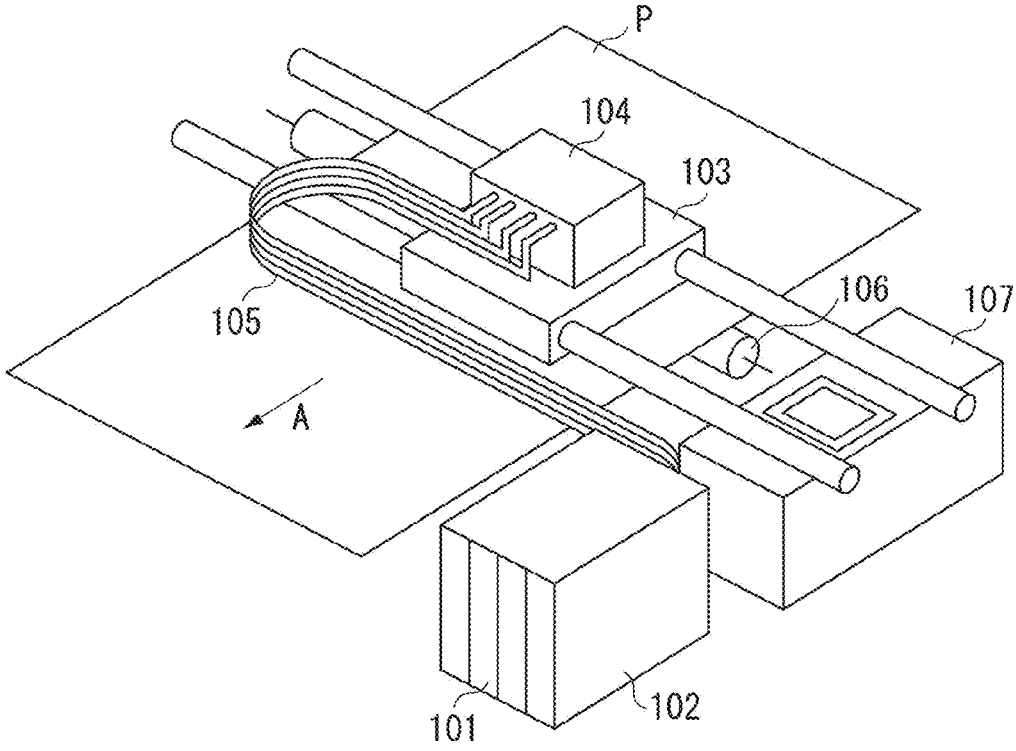
FIG. 1 is a perspective view illustrating a printing apparatus according to an exemplary embodiment of the present invention.

FIG. 1 is a perspective view illustrating a printing apparatus according to an exemplary embodiment of the present invention. In FIG. 1, an ink tank 101 stores ink. Respective ink tanks which store yellow ink, magenta ink, cyan ink, and black ink are provided. On an ink tank holder 102, a plurality of ink tanks 101 can be attached.

A carriage 103 is moved with a print head (recording head) (not illustrated) mounted. The print head discharges ink onto a recording medium P to execute recording. On the carriage 103, the print head (not illustrated) and a sub tank 104 for storing ink to be supplied to the print head are mounted. The ink tank 101 and the sub tank 104 are connected by an ink supply tube 105. Ink stored in the ink tank 101 is supplied to the sub tank 104 via the ink supply tube 105.

A conveyance roller 106 conveys the recording medium P in a direction which intersects with a moving direction of the carriage 103. A recovery unit 107, which executes a recovery operation of the print head (recording head), is disposed outside a region to which the recording medium P is conveyed. The recovery unit 107 includes a cap for capping the face of a discharge port of the print head, a wiper for wiping the face of the discharge port, and a pump for suctioning ink from the print head.

Figure 2A:
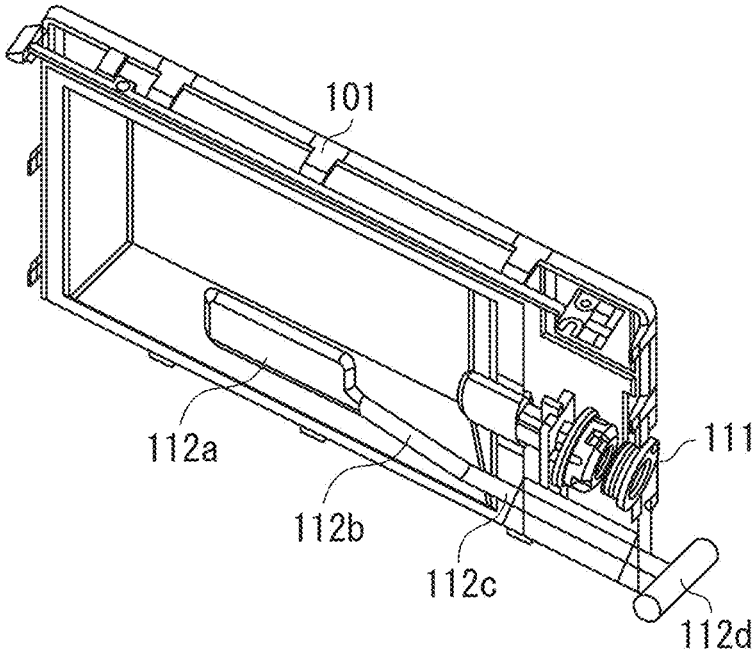
FIGS. 2A and 2B are diagrams illustrating an ink tank according to an exemplary embodiment of the present invention.
Figure 2B:
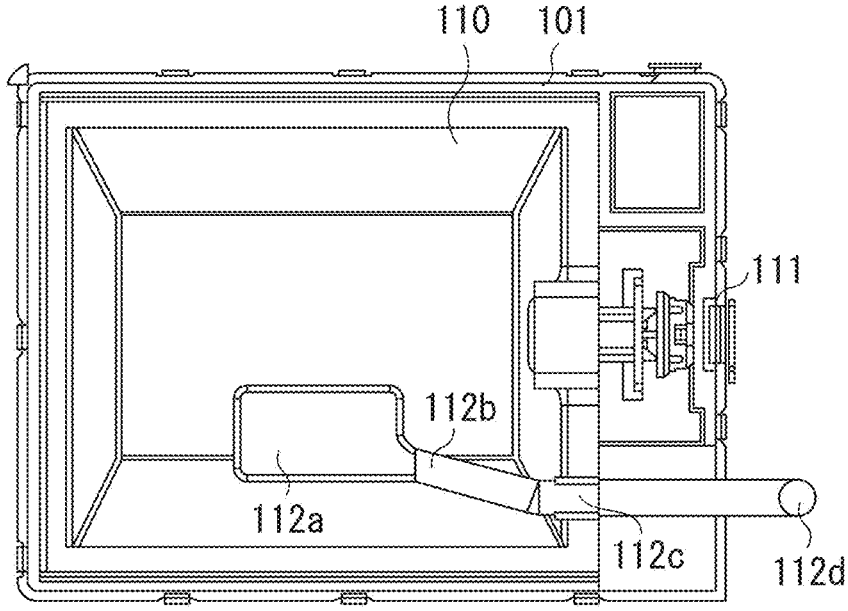

FIGS. 2A and 2B are diagrams illustrating the ink tank 101 according to the present exemplary embodiment. FIG. 2A is an internal perspective view illustrating the ink tank 101. FIG. 2B is a cross sectional view illustrating the ink tank 101. In FIGS. 2A and 2B, inside the ink tank 101, an ink storage bag 110 is provided. The ink storage bag 110 is formed by joining two films. Inside the ink storage bag 110, ink in which a pigment for printing is dispersed in a solvent is stored. In the present exemplary embodiment, ink in the ink storage bag 110 is described as pigment ink. However, even if it is dye ink or a processing liquid, it is similarly effective. The present exemplary embodiment is particularly effective in a configuration in which ink a component of which easily precipitates is used. At the end of the ink storage bag 110, an ink supply portion 111 is projected so as to be partially exposed. Ink in the ink storage bag 110 is supplied from the ink supply portion 111. More specifically, ink is supplied from the ink supply portion 111 to the sub tank 104 via the ink supply tube 105.

A stirring member 112 includes a stirring portion 112*a* configured to stir ink, a flexible elastic portion 112*b*, a joining portion 112*c* configured to join with a film of the ink storage bag 110, and a drive input portion 112*d* protruded outside the ink tank 101. As described below, when the drive input portion 112*d* is swung, the stirring portion 112*a* swings with the joining portion 112*c* served as an intersection point, so that ink in the ink storage bag 110 is stirred. Swinging of the stirring portion 112*a* allows a pigment component precipitating in the ink storage bag 110 to be stirred, thus reducing inconsistencies in density of ink.

Figure 3:
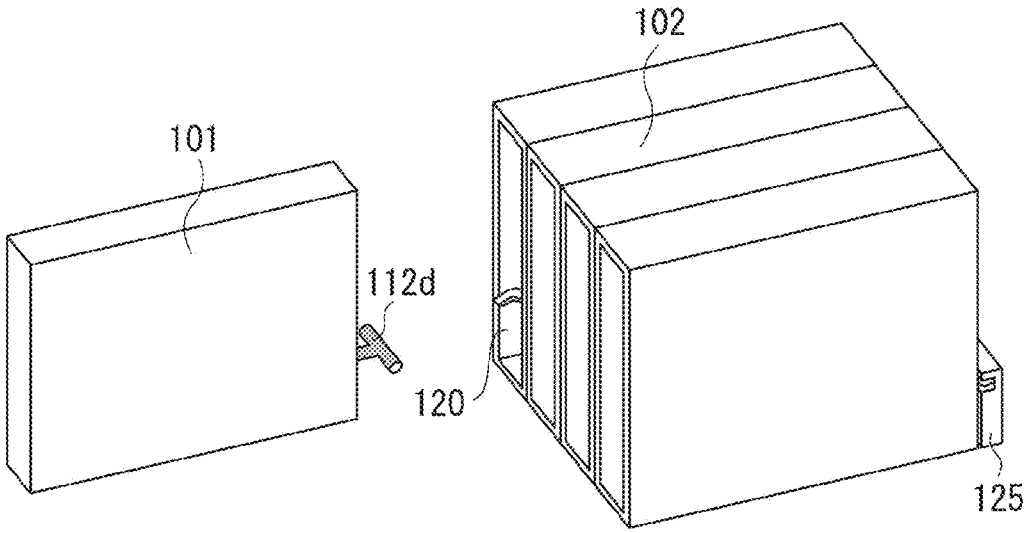
FIG. 3 is a perspective view illustrating a configuration in which an ink tank engages with an ink tank holder.

FIG. 3 is a perspective view illustrating a configuration in which the drive input portion 112*d* on the ink tank 101 engages with the ink tank holder 102. When the ink tank 101 is attached to a printing apparatus main body, the ink tank 101 is inserted from the opening provided on the front side of the ink tank holder 102. On an attachment portion configured to attach each ink tank 101 to the ink tank holder 102, an engaging portion 120 capable of engaging with the drive input portion 112*d* on the ink tank 101 is provided. Further, in FIG. 3, when the ink tank 101 is completely attached to the ink tank holder 102, the drive input portion 112*d* on the ink tank 101 engages with a driving unit 125. When the driving unit 125 is driven with the drive input portion 112*d* on the ink tank 101 engaging with the dive unit 125, the drive input portion 112*d* is swung. When the drive input portion 112*d* is swung, in response thereto, the stirring portion 112*a* swings, so that ink in the ink storage bag 110 can be stirred.

Figure 4:
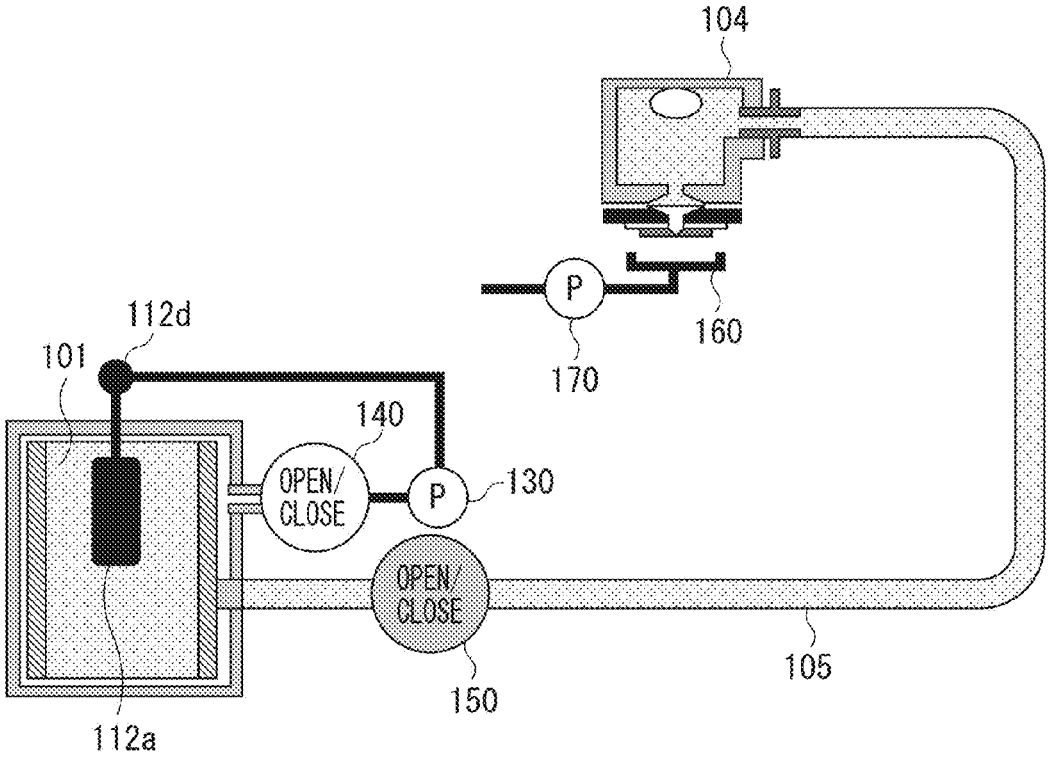
FIG. 4 is a schematic diagram illustrating a configuration in which ink is supplied from an ink tank to a print head.

FIG. 4 is a schematic diagram illustrating a configuration in which ink is supplied from the ink tank 101 to the print head. By driving a pressure pump 130, the drive input portion 112*d* of the stirring member 112 is swung. By causing the drive input portion 112*d* to swing, the stirring portion 112*a* swings and ink in the ink storage bag 110 is stirred. In the present exemplary embodiment, the pressure pump 130 is a diaphragm pump. A motor is served as a driving source for the pressure pump 130. When the pressure pump 130 is normally rotated, the drive input portion 112*d* of the stirring member 112 is driven and the stirring operation of the ink tank 101 is executed. When the pressure pump 130 is reversely rotated, drive is not transmitted to the stirring member 112 and the stirring operation of the ink tank 101 is not executed.

A solenoid valve 140 connects the ink tank 101 and the pressure pump 130. The pressure pump 130 conveys air for pressurizing the ink storage bag 110. The solenoid valve 140 switches between an open and a closed state according to turning on and off of power. With the solenoid valve 140 opened, the pressure pump 130 and the inside of the ink tank 101 communicate with each other. When the pressure pump 130 is normally or reversely rotated with the solenoid valve 140 opened, the inside of the ink tank 101 is pressurized. In other words, the solenoid valve 140 functions as a switch member to switch whether to introduce air conveyed by the pressure pump 130 into the ink tank 101. When the inside of the ink tank 101 is pressurized, the ink storage bag 110 is crushed. Thus, ink can be supplied from the ink tank 101 to the print head via the ink supply tube 105. More specifically, when the pressure pump 130 is normally rotated with the solenoid valve 140 opened, the ink storage bag 110 in the ink tank 101 is pressurized and also ink in the ink storage bag 110 is stirred. Further, when the pressure pump 130 is normally rotated with the solenoid valve 140 closed, ink in the ink storage bag 110 is stirred. At this time, the ink storage bag 110 is not pressurized. In the present exemplary embodiment, the stirring member 112 is configured to be driven by the pressure pump 130, by which air for pressurizing the ink storage bag 110 is conveyed. However, the stirring member 112 may be configured to be driven by another driving source.

A differential pressure regulating valve 150 is provided on the way of the ink supply tube 105. The differential pressure regulating valve 150 is opened when a pressure on the upstream side (ink tank 101 side) of the differential pressure regulating valve 150 is higher than a pressure on the downstream side (print head side) of the differential pressure regulating valve 150 by a predetermined quantity or more.

A cap 160 can abut on the face of the discharge port of the print head. A suction pump 170 is a pressure reducing unit (negative pressure generation unit) connected to the cap 160. By driving the suction pump 170, a negative pressure can be generated in the cap 160. By generating a negative pressure in the cap 160, thickened ink and air bubbles can be discharged from the print head, and ink can be supplied from the ink tank 101 to the print head.

Next, choke suction will be described. When a fixed quantity or more of air bubbles or thickened ink is present in the ink supply path, ink supply to a nozzle on the print head is blocked and a discharge defect may occur. As a method for preventing the discharge defect, choke suction is effectively used which discharges air bubbles or thickened ink in the ink supply path by ink flow high in flow rate. In the choke suction, the print head side may be reduced in pressure from the valve on the ink supply path and also the cartridge side may be pressurized from the valve on the ink supply path.

A basic configuration of the choke suction in the present exemplary embodiment will be described. A differential pressure regulating valve is provided on an ink supply path from an ink tank to a print head. Ink is supplied from the differential pressure regulating valve on the ink supply path by a difference in pressure between the ink tank side and the print head side.

Figure 5:
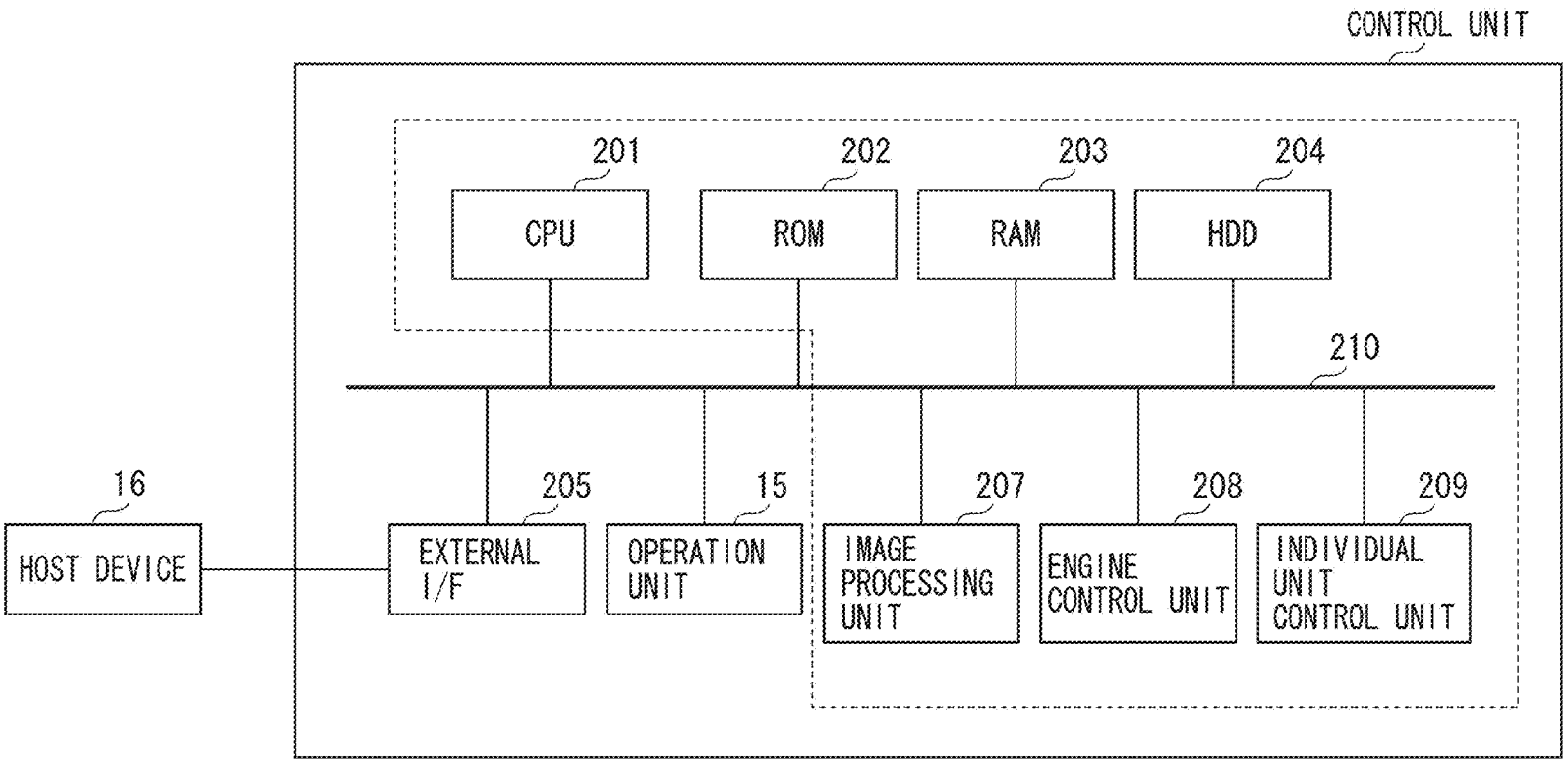
FIG. 5 is a block diagram illustrating a control unit according to an exemplary embodiment of the present invention.

FIG. 5 is a block diagram illustrating a concept of a control unit according to the present exemplary embodiment. A controller (a region surrounded with the broken line) contained in the control unit includes a central processing unit (CPU) 201, a read only memory (ROM) 202, a random access memory (RAM) 203, a hard disk drive (HDD) 204, an image processing unit 207, an engine control unit 208, and an individual unit control unit 209. The CPU 201 comprehensively controls the operation of each unit on the printing apparatus. The ROM 202 stores a program to cause the CPU 201 to execute it and fixed data required for various operations of the printing apparatus. The RAM 203 is used as a work area for the CPU 201, used as a temporally storage area of various received data, and stored with various setting data. The HDD 204 can store and read a program to cause the CPU 201 to execute it, print data, and setting information required for various operations of the printing apparatus. An operation unit 15 is an input and output interface to a user. The operation unit 15 includes an input unit such as a hard key and a touch panel, and an output unit such as a display to provide information and a sound generation device. For example, a display with a touch panel is used, and an operation status of the apparatus, a print condition, maintenance information (ink remaining amount, sheet remaining amount, maintenance status, etc.), or the like is displayed to a user. A user can input various types of information from the touch panel.

With respect to a unit in which high-speed data processing is required, an exclusive processing unit is provided. The image processing unit 207 executes image processing of print data which is handled with the printing apparatus. A color space (e.g., YCbCr) of the input image data is converted into a standard RGB color space (e.g., sRGB). Further, various types of image processing such as resolution conversion, image analysis, and image correction are performed to image data as required. Print data obtained by these types of image processing is stored in the RAM 203 or the HDD 204. The engine control unit 208 also executes drive control of the print head according to print data based on control commands received from the CPU 201 or the like. The individual unit control unit 209 is a sub controller for individually controlling respective units, such as the pressure pump 130, the solenoid valve 140, the cap 160, and the suction pump 170. The individual unit control unit 209 controls the operation of each unit based on commands by the CPU 201. An external interface 205 is an interface (I/F) for connecting the controller to a host device 16. The external interface 205 is a local I/F or a network I/F. The above components are connected by a system bus 210.

The host device 16 is a device served as a supply source of image data to cause the printing apparatus to execute printing. The host device 16 may be a general purpose or an exclusive computer, or an exclusive imaging apparatus, such as an image capture having an image reader unit, a digital camera, and a photo storage. When the host device 16 is a computer, in a storage device included in the computer, an operating system (OS), application software to generate image data, and a print driver for the printing apparatus are installed. It is not essential to realize all of the above processing by software. A part or the whole thereof may also be realized by hardware.

Figure 6:
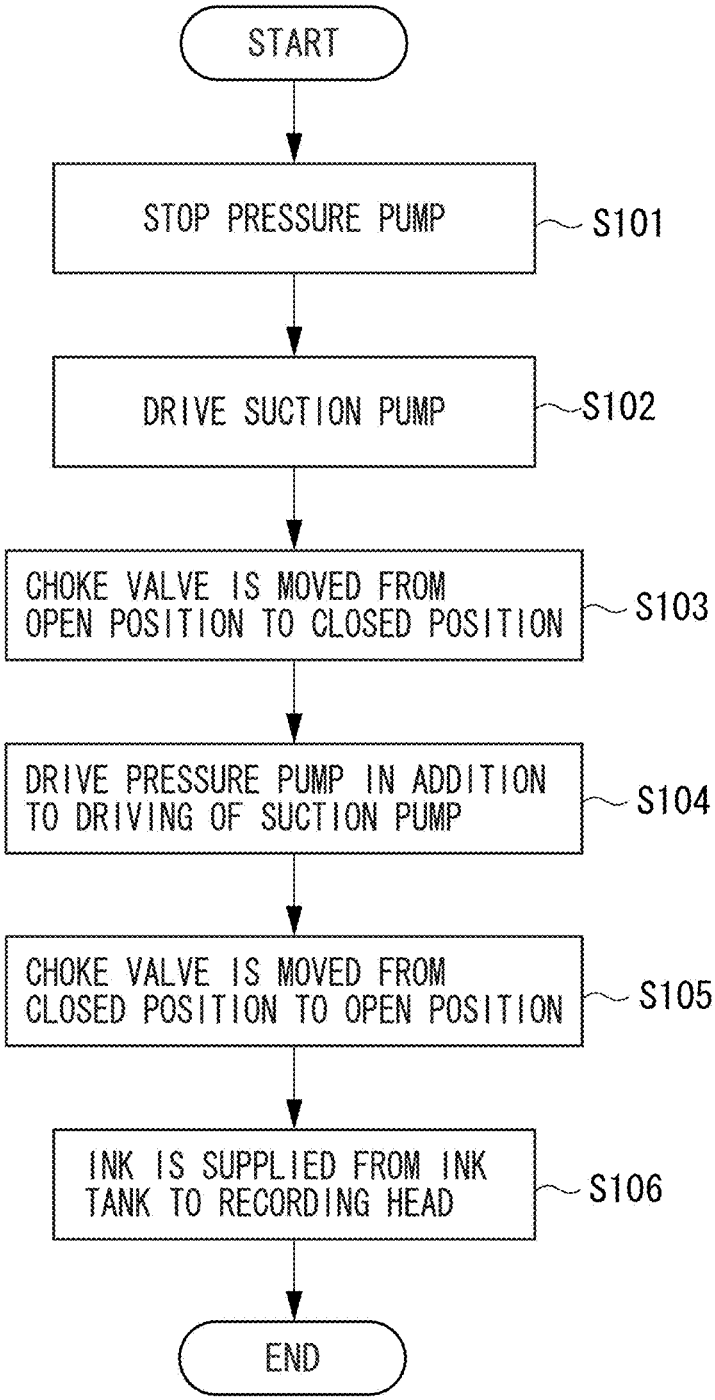
FIG. 6 is a flowchart illustrating an operation of choke suction according to an exemplary embodiment of the present invention.

FIG. 6 is a flowchart illustrating an operation of choke suction according to the present exemplary embodiment. In step S101, the CPU 201 stops driving of the pressure pump 130. By stopping the driving of the pressure pump 130, the CPU 201 releases a pressurized condition in an ink supply path. In step S102, the CPU 201 starts driving of the suction pump 170. By driving the suction pump 170, a pressure in the ink supply path is reduced. Then, when the pressure in the ink supply path is reduced lower than a predetermined pressure, in step S103, the differential pressure regulating valve 150, which has been opened, is closed. Specifically, a valve member is moved to block the ink supply path, whereby the upstream side and the downstream side of the ink supply path are intercepted. After the differential pressure regulating valve 150 is closed, the driving of the suction pump 170 is continued. By continuing the driving of the suction pump 170, the absolute value of a negative pressure in the ink supply path downstream of the differential pressure regulating valve 150 is increased.

In step S104, after the elapse of a predetermined time since the driving of the suction pump 170 is started, the CPU 201 starts driving of the pressure pump 130. By driving the pressure pump 130, a pressure in the ink supply path on the ink tank side (upstream side) of the differential pressure regulating valve 150 is increased. When a pressure on the upstream side of the differential pressure regulating valve 150 is increased higher than a pressure on the print head side (downstream side) of the differential pressure regulating valve 150 by a predetermined quantity or more, then in step S105, the differential pressure regulating valve 150, which has been closed, is opened. Specifically, the valve member is located in a position where the ink supply path is intercepted by a negative pressure on the downstream side of the ink supply path. An increase in the pressure on the upstream side of the ink supply path causes the valve member to be moved against the negative pressure on the downstream side to open the ink supply path.

When the differential pressure regulating valve 150 is opened, then in step S106, ink is supplied from the ink tank 101 to the print head by a difference in pressure between the upstream side and the downstream side.

The choke suction is required mainly in the following cases. A first case is where the printing apparatus is unused for a long period of time. When the printing apparatus is in an unused state for a long period of time, thickened ink or air bubbles may remain in the ink supply path, so that a discharge defect of the print head may occur.

A second case is where a long period of time elapses after the ink supply path is filled with ink. Also in this case, the thickened ink or the air bubbles may remain in the ink supply path and the discharge defect of the print head may occur. A long period of time in the first case and the second case is about 1.5 months.

A third case is where the printing apparatus is attached with a new ink tank. This is because when the new ink tank is attached to the printing apparatus, a small quantity of air bubbles may enter the ink supply path. In consideration of the frequency where an ink tank was replaced, when it seems that a predetermined quantity or more of air bubbles remains in the ink supply path, the choke suction is performed.

When the choke suction is performed, it is desirable that the density of ink in the ink tank is uniform. When pigment ink is used, if a pigment component precipitates, ink the pigment component of which precipitates is supplied to the print head. In the above-described three cases where the choke suction is required, the pigment component may precipitate in the ink tank.

Thus, when the choke suction is performed, it is desirable to solve the precipitation state of the pigment component in the ink tank by a stirring operation before the choke suction is performed. In such a case, in a conventional configuration, the choke suction is performed after the pigment component in the ink tank is stirred by a stirring unit. Accordingly, a user of the printing apparatus is needed to wait for a period of time required to perform the choke suction in addition to a stirring time required to solve precipitation of the pigment component.

The stirring time required to solve precipitation of the pigment component is, for example, determined as follows. First, a patch is recorded with sufficiently stirred uniform ink. Next, a patch is recorded with ink a pigment component of which has precipitated stirred for N seconds. These patches are subjected to color measurement to find a color difference $\Delta E$ thereof. With the stirring time gradually changed, patches are recorded and each color difference $\Delta E$ is measured. Then, a relationship between the stirring time and the color difference $\Delta E$ is found. Based on this relationship, a required stirring time for reducing the color difference $\Delta E$ from uniform ink to a predetermined value or less can be determined.

Figure 7:
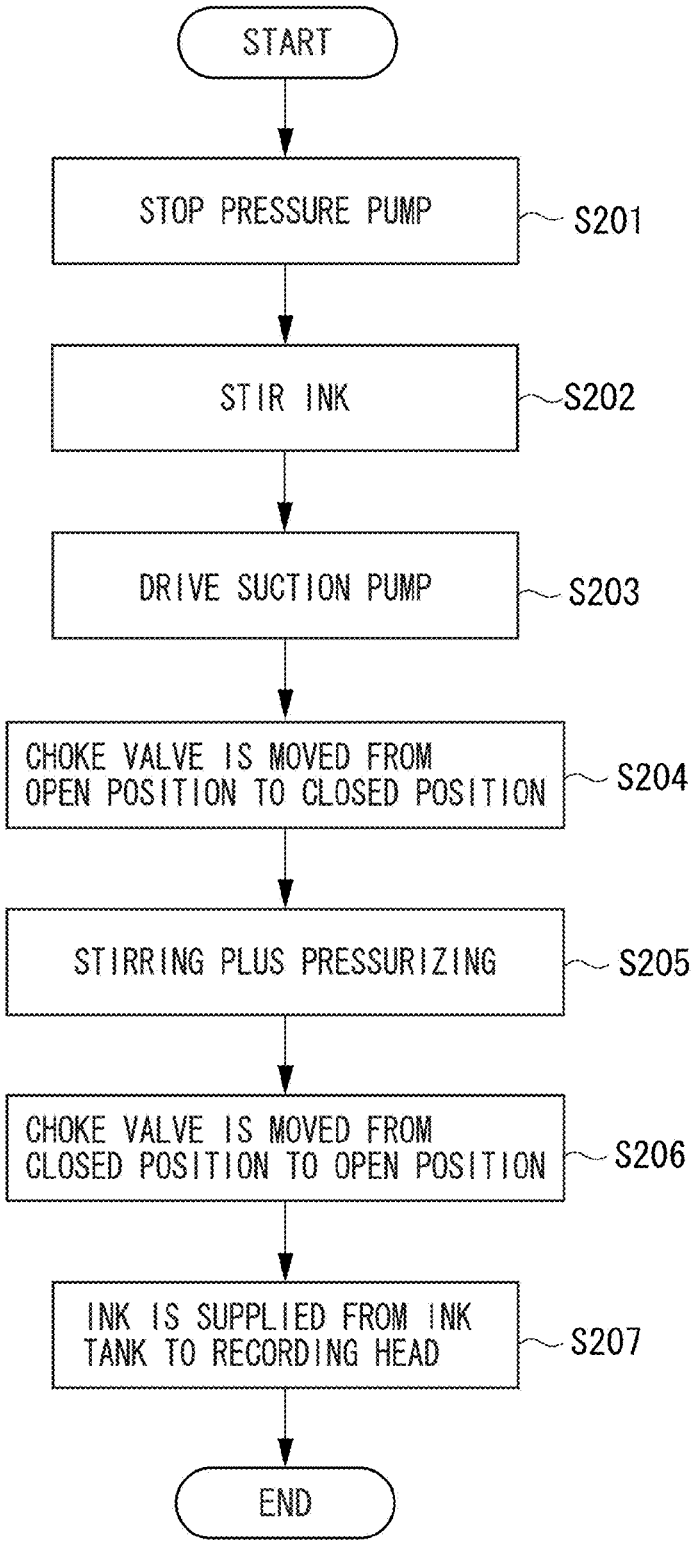
FIG. 7 is a flowchart illustrating an ink supply operation according to an exemplary embodiment of the present invention.
Figure 8:
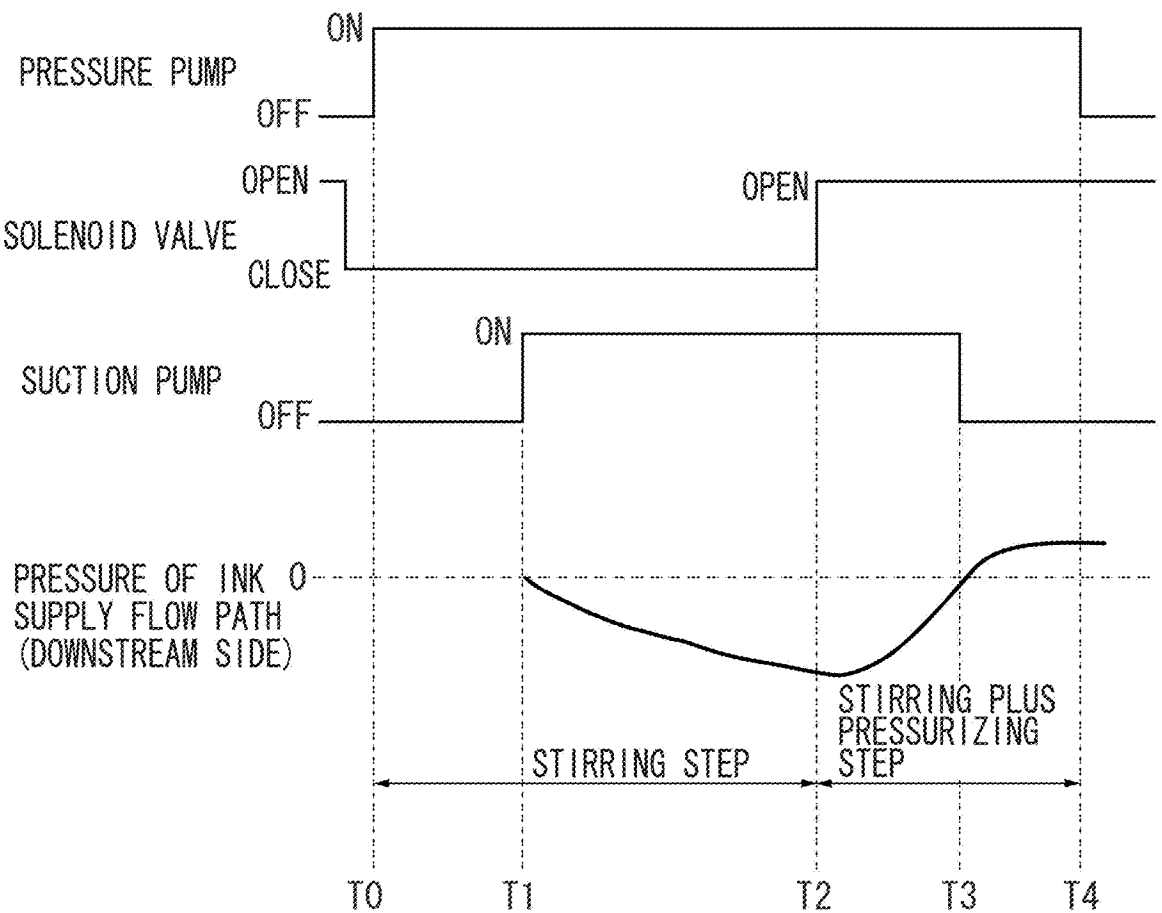
FIG. 8 is a diagram illustrating timing of an ink supply operation according to an exemplary embodiment of the present invention.

FIG. 7 is a flowchart illustrating an ink supply operation according to the present exemplary embodiment. FIG. 8 is a diagram illustrating timing of the ink supply operation according to the present exemplary embodiment.

In step S201 illustrated in FIG. 7, the CPU 201 stops the driving of the pressure pump 130. Timing to stop the driving of the pressure pump 130 is point of time T0 in FIG. 8. The CPU 201 stops the driving of the pressure pump 130, whereby a pressurized condition in the ink supply path is released. In step S202, the CPU 201 closes the solenoid valve 140 and normally rotates the pressure pump 130, thereby causing the stirring member 112 to swing to stir ink in the ink storage bag 110.

After the elapse of a predetermined time since the stirring operation of ink is started, then in step S203, the CPU 201 starts driving of the suction pump 170. Timing to start the driving of the suction pump 170 is point of time T1 in FIG. 8. By starting the driving of the suction pump 170, pressure in the ink supply path is reduced. In parallel with an operation to reduce pressure in the ink supply path by the suction pump 170, the stirring operation in the ink tank 101 can be executed. Then, when a pressure in the ink supply path is reduced to lower than a predetermined pressure, then in step S204, the differential pressure regulating valve 150, which has been opened, is closed. After the differential pressure regulating valve 150 is closed, the driving of the suction pump 170 is continued. By continuing the driving of the suction pump 170, the absolute value of a negative pressure in the ink supply path downstream of the differential pressure regulating valve 150 is increased.

In step S205, the CPU 201 opens the solenoid valve 140 while driving the pressure pump 130, to swing the stirring member 112 and pressurize the ink storage bag 110. Timing to open the solenoid valve 140 is point of time T2 in FIG. 8. By driving the pressure pump 130, pressure in the ink supply path on the upstream side of the differential pressure regulating valve 150 is increased. At this time, the driving of the suction pump 170 is continued. By driving the suction pump 170 and the pressure pump 130, when a pressure on the upstream side of the differential pressure regulating valve 150 becomes higher than a pressure on the downstream side of the differential pressure regulating valve 150 by a predetermined quantity or more, then in step S206, the differential pressure regulating valve 150, which has been closed, is opened.

When the differential pressure regulating valve 150 is opened, then in step S207, ink is supplied from the ink tank 101 to the print head by a difference in pressure between the upstream side and the downstream side. After the elapse of a predetermined time, the CPU 201 stops the driving of the suction pump 170. Timing to stop the driving of the suction pump 170 is point of time T3 in FIG. 8. Further, after the elapse of a predetermined time, the CPU 201 stops the driving of the pressure pump 130. Then, the operation ends. Timing to stop the driving of the pressure pump 130 is point of time T4 in FIG. 8. By stopping the driving of the pressure pump 130, the stirring operation and the pressurizing operation end.

In the present exemplary embodiment, the stirring step can be executed in parallel with the pressure reducing step by the suction pump 170 or the pressurizing step by the pressure pump 130. Thus, a period of time required to supply ink from the ink tank 101 to the print head can be shortened. Further, in the stirring plus pressurizing step where the stirring operation and the pressurizing operation are executed in parallel, ink in the ink tank 101 is pressurized and supplied into the ink supply path at a high speed while being stirred. At this time, the suction pump 170 is driven, whereby the downstream side of the ink supply path is sufficiently reduced in pressure. Thus, owing to a difference in pressure between the upstream side and the downstream side, directly after the differential pressure regulating valve 150 is opened, ink in the ink tank 101 is moved to the print head at a high speed. Ink that is moved at this time stirs the surrounding ink and also ink itself is stirred by the surrounding ink. Thus, a stirring is effective. When the differential pressure regulating valve 150 is opened and ink is moved, ink is stirred. Thus, a stirring time in the ink storage bag can be reduced.

In the present exemplary embodiment, a configuration has been described in which the differential pressure regulating valve 150 is automatically opened by a difference in pressure between the upstream side of the differential pressure regulating valve 150 and the downstream side of the differential pressure regulating valve 150 on the ink supply path. However, a valve provided on the ink supply path may also be configured as a valve that is opened and closed with a driving source. If a valve is configured so as to be opened and closed with the driving source, it may also be configured such that only a pressure on the downstream side of the valve is increased with a pressure on the upstream side of the valve being atmospheric pressure. Further, it may also be configured such that only a pressure on the downstream side of the valve is reduced with a pressure on the upstream side of the valve being atmospheric pressure.

Conventionally, it takes about 120 seconds to execute stirring in the ink storage bag. However, in the present exemplary embodiment, it can be reduced to about 75 seconds. Further, conventionally, after the stirring operation, the suction pump is driven and the ink supply path is reduced in pressure. Thus, it takes about 60 seconds to perform the choke suction. In the present exemplary embodiment, since the pressurizing operation of the ink storage bag and driving of the suction pump are executed during the stirring operation, the operation of the stirring plus pressurizing step can be reduced to about 15 seconds. Accordingly, the operation, where conventionally it takes 180 seconds to execute stirring and choke suction, can be reduced to 90 seconds in the present exemplary embodiment.

In the above-described exemplary embodiment, a stirring effect in the stirring plus pressurizing step is enhanced, whereby a period of time required for stirring can be shortened. In order to further enhance the stirring effect, a mechanism serving as an ink storage chamber or flow resistance may also be provided on the ink supply path between the ink tank and the sub tank. Further, a similar mechanism may also be provided in the ink tank. By providing these mechanisms, an ink flow effect in the ink supply path is enhanced at the stirring plus pressurizing step. Accordingly, a stirring time at the stirring plus pressurizing step can be shortened.

According to an exemplary embodiment of the present invention, a printing apparatus and an ink supply method thereof can be provided which allow a period of time required for the ink stirring operation and the ink supply operation to the print head to be shortened.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-139962 filed Jun. 18, 2010, which is hereby incorporated by reference herein in its entirety.

What is claimed is:

1. A printing apparatus comprising:

a print head configured to discharging ink;

an ink storage bag for storing ink to be supplied to the print head;

a stifling member configured to stir ink in the ink storage bag;

a pressure unit configured to pressurize the ink storage bag;

a supply path for supplying ink from the ink tank storage bag to the print head;

a valve disposed in the supply path;

a suction unit configured to suck ink from the print head; and a control unit configured to control the stirring portion member, the pressure unit and the suction unit, wherein the control unit drives the suction unit after driving the stirring member, thereby closing the valve, and subsequently drives the pressure unit while continuing to drive the stirring member.

2. The printing apparatus according to claim 1, wherein the pressure unit includes a pressure pump for conveying air to pressurize the ink storage bag, and a switching member for switching in order to introduce air conveyed by the pressure pump into the ink tank.

3. The printing apparatus according to claim 1, wherein the valve is a differential pressure regulating valve that is opened and closed according to a difference in pressure between the ink tank side from the valve in the supply path and the print head side in the supply path, and wherein the differential pressure regulating valve being opened allows ink to be supplied from the ink tank to the print head.

4. The printing apparatus according to claim 1, wherein the control unit opens the valve while driving the stirring member.

5. The printing apparatus according to claim 1, wherein the stirring member and the pressure unit are driven by an identical drive source.

6. An ink supply method for a printing apparatus including a print head configured to discharge ink, an ink storage bag for storing ink to be supplied to the print head, a stirring member configured to stir ink in the ink storage bag, a pressure unit configured to pressurize the ink storage bag, a supply path for supplying ink from the ink supply bag to the print head, a valve disposed in the supply path and a suction unit configured to suck ink from the print head, the ink supply method comprising:

driving the suction unit after driving the stirring member, thereby closing the valve; and subsequently driving the pressure unit while continuing to drive the stirring member.

* * * * *